US006299963B1

(12) United States Patent
Banks et al.

(10) Patent No.: US 6,299,963 B1
(45) Date of Patent: Oct. 9, 2001

(54) SUPERPLASTICALLY FORMED PANEL

(75) Inventors: Samual James Banks; John Ross Mark Pilling, both of Preston (GB)

(73) Assignee: British Aerospace, plc., Farnborough (GB)

( * ) Notice: Subject to any disclaimer, the term of this patent is extended or adjusted under 35 U.S.C. 154(b) by 0 days.

(21) Appl. No.: 09/455,776

(22) Filed: Dec. 7, 1999

Related U.S. Application Data

(63) Continuation of application No. PCT/GB99/01007, filed on Mar. 31, 1999.

(30) Foreign Application Priority Data

Apr. 7, 1998 (GB) ..... 9807479

(51) Int. Cl.[7] ..... B32B 3/12

(52) U.S. Cl. ..... 428/116; 428/131; 264/239; 29/423

(58) Field of Search ..... 428/118, 116, 428/131; 264/239; 29/423

(56) References Cited

U.S. PATENT DOCUMENTS

| | | |
|---|---|---|
| 4,351,470 | 9/1982 | Swadling et al. . |
| 4,509,671 | 4/1985 | Weisert . |
| 5,205,467 | 4/1993 | Sarkisian et al. . |
| 5,603,449 | 2/1997 | Mansbridge et al. . |

FOREIGN PATENT DOCUMENTS

| | | | |
|---|---|---|---|
| 2 272 660 | | 5/1994 | (GB) . |
| 59-169692 | * | 9/1984 | (JP) . |
| 97/27045 | | 7/1997 | (WO) . |
| 99/51372 | | 10/1999 | (WO) . |

* cited by examiner

*Primary Examiner*—Blaine Copenheaver
*Assistant Examiner*—Wendy Boss
(74) *Attorney, Agent, or Firm*—Pillsbury Winthrop LLP

(57) ABSTRACT

The present invention provides a method of forming and a composite superplastically formed structure comprising a panel (40) provided by at least a pair of superplastically-formed sheets (12, 14, 16, 18), which together form a plurality of cells (42), the panel having an opening (20) therein or therethrough defined by a side wall (48) of a respective one, or side walls (48) of respective ones, of the cells; and an insert plug (38) received in the opening and bonded to the said wall or walls.

17 Claims, 2 Drawing Sheets

SUPERPLASTICALLY FORMED PANEL

This is a continuation of International Application PCT/GB99/01007, with an international filing date of Mar. 31, 1999, now WO 99/51372.

TECHNICAL FIELD

The present invention relates to a panel that may be formed by diffusion bonding and superplastic forming (DB/SPF). The invention has particular application in the aerospace industry in the production of panels and structures for constructing aircraft.

BACKGROUND ART

Combined diffusion bonding and superplastic forming is an established technique for making structural components, particularly lightweight components requiring complex internal structure, from materials that exhibit superplastic properties at elevated temperatures. These materials are primarily titanium, aluminium and alloys of both these metals.

In established DB/SPF processes, for example see U.S. Pat. Nos. 5,143,276, 4,534,503, GB-2030480, GB-2129340, U.S. Pat. Nos. 4,607,783, 4,351,470, 4,304,821 and EP-0502620, it is known to apply stop-off material to selected areas of two or more sheets of superplastic material; several sheets, including the sheets to which stop-off material has been applied, are then assembled into a pack with the stop-off material lying between adjacent superplastic sheets. The assembled pack is then heated and compressed until the sheets are diffusion bonded together; however, the sheets are not bonded in the selected areas covered by stop-off material since the stop-off material prevents diffusion bonding in those areas. The superplastic forming step is then conducted by heating the bonded pack, usually in a mould, to a temperature at which the components exhibit superplastic properties. An inert gas is then injected in a controlled manner into the unbonded areas of the pack under high pressure so as to "inflate" the sheets gradually into a three dimensional structure having an outer shape corresponding to the shape of the mould. The configuration of the final composite structure is dependent upon, among other things, the number of sheets in the pack, the location of the stop-off material and the shape of the mould.

It is known, for example from GB-1495655, to form a composite panel from a pack comprising a pair of opposed face sheets and a core sheet sandwiched between, and bonded at selected points to, the face sheets; in the superplastic forming process, the face sheets are forced apart and because the internal core sheet is selectively attached to both of the face sheets, the core sheet adopts a zigzag shape that, in effect, constitutes struts extending from one face sheet to the other.

U.S. Pat. Nos. 4,304,821 and 5,143,276 each describes the making of a panel from four sheets of superplastic material from a pack comprising a pair of opposed face sheets and two core sheets sandwiched between the face sheets; the two core sheets are bonded to each other at selected points by linear welds. The face sheets are superplastically formed by injecting gas into the area between each face sheet and the adjacent core sheet to expand the face sheets into the shape of a mould; gas is then injected between the two core sheets. Because the core sheets are selectively joined by the linear welds, the core sheets expand to form cells extending between the face sheets; the side walls of the cells are formed by U-shaped doubled-back sections of the two core sheets.

The superplastically formed panels produced using these known techniques have many advantages but they are not suitable for withstanding localised high loads, for example where other external components will bear on or are to be attached to the panels.

EP-754098 proposes a process for superplastically forming a part for use as an aircraft component, in which localised pre-thinning of a sheet is employed to facilitate superplastic forming in areas where forming tends to be slow and thus to avoid excess thinning in other areas of the part. In this way, the overall thickness of the sheet can be controlled during forming and hence the strengthening of given areas of the final part is possible.

Another process for stiffening a superplastically formed panel is described in U.S. Pat. No. 4,632,296. In this process, the initial thickness of predetermined areas of the sheets to be formed is selected to control the rate of superplastic deformation of the sheet during forming. This can be used both to avoid areas of malformation and to produce reinforced areas of extra strength in the final panel.

Nevertheless, neither of these two prior references addresses the problem of providing in a superplastically formed panel localised areas capable of withstanding substantial point loads, for example where other components will bear on or require load bearing attachment to the panel.

Furthermore, none of the prior methods provides a superplastically formed panel suitable for machining, post forming, in order to enable the attachment of other components.

The present invention addresses these problems and seeks to overcome them by providing a superplastically formed structure that is more robust than prior art panels and that has localised load bearing areas.

DISCLOSURE OF THE INVENTION

According to one aspect of the present invention, a superplastically formed composite structure comprises:

- a panel provided by a pair of superplastically-formed sheets, which together form a plurality of cells, the panel having an insert opening therein defined by a side wall of a respective one, or side walls of respective ones, of the cells; and
- an insert plug received in the insert opening and bonded to the said side wall or walls.

The panel may further include face sheets forming the outer faces of the panel.

The insert plug itself is intended to provide a solid relatively hard region in the panel, which is capable of sustaining substantial point loads without collapse, buckling or racture. For example, the structure may in use be subjected to such loads at areas of contact with other components, and the insert plug may be employed in these areas to act as a hinge point or an attachment point for the other component.

The insert plug may accordingly be substantially solid and of generally cylindrical or frusto-conical shape. It may also be pre-formed with a central bore and/or machined after forming according to its intended purpose.

The material forming the cell side wall or walls should have superplastic properties at an elevated temperature, and may for example be titanium or aluminium or alloys thereof. The insert plug may also have superplastic properties and be made from a similar material but this is not essential.

The bonds between the superplastically formed sheets and the insert plug may be brought about by diffusion bonding, explosive bonding, welding or indeed any other process that forms strong bonds to retain the insert plug in place.

In one of the embodiments described below, the insert plug is made from the same material as the superplastically formed sheets and is located in place and diffusion bonded to them during forming.

In another of the embodiments described below, the insert plug is made from a different material and is inserted into the panel opening after forming and first edge welded and then HIP (Hot Isostatic Pressure) bonded in place.

The structure of the present invention may be used to form a beam, bar, strut or frame or some such similar structure, particularly for use in constructing aircraft.

According to another aspect of the present invention, a method of producing a superplastically formed composite structure comprises:

providing a pack or stack of sheets of superplastically formable material;

defining an insert location in the pack and joining the sheets together by bonds at least in the region of the insert location;

placing the pack in a forming tool and superplastically forming the sheets by heating the sheets to a temperature at which they exhibit superplastic properties and by injecting gas so as to expand the pack into a three dimensional panel having a plurality of cells, wherein the insert location becomes an insert opening defined by a side wall of a respective one, or side walls of respective ones, of the cells; and locating an insert plug in the insert opening and bonding the plug to the said side wall or walls.

Preferably, the insert location comprises an aperture through the pack.

In one embodiment of the invention described below, the insert plug is located in the aperture prior to forming, and is diffusion bonded to the said side wall or walls during the superplastic forming.

In another embodiment of the invention described below, the aperture is located over a withdrawable core plug of the forming tool for forming, and after forming the core plug is withdrawn and the insert plug is inserted into the insert opening and is bonded to the said side wall or walls.

Alternatively, the insert location may simply be a defined sheet region of the pack. This sheet region may then be located adjacent an end of the insert plug, or of a withdrawable core plug of the forming tool, for forming, following which the sheet region becomes formed into an insert opening that is closed at one end in which the insert plug is received or receivable.

DESCRIPTION OF THE DRAWINGS

The invention will be further described, by way of example only, with reference to the accompanying drawings in which.

DETAILED DESCRIPTION OF THE PREFERRED EMBODIMENTS

Figure 1:
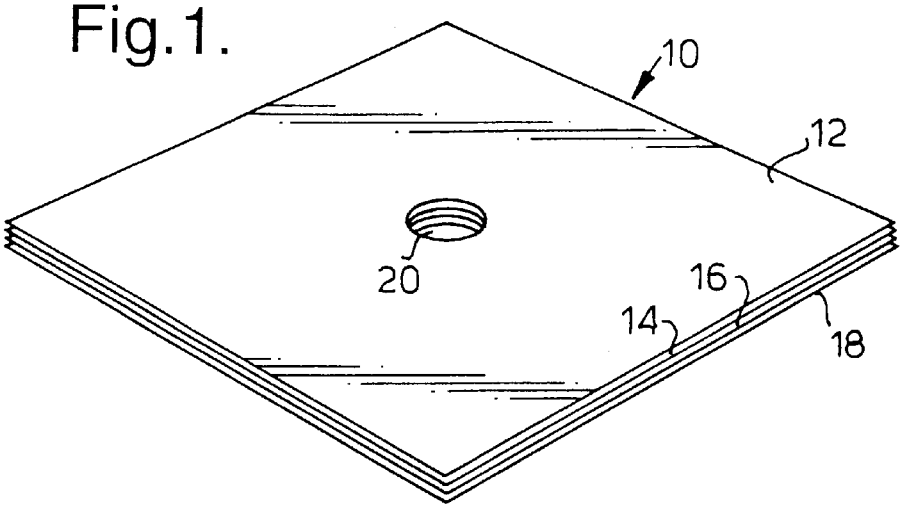
FIG. 1 shows a pack of titanium sheets that can be used in the present invention.

Referring to the accompanying Figures, and initially to FIG. 1, a stack or pack 10 is produced, which is composed of four sheets 12,14,16,18, the sheets being made of a material that has superplastic properties at elevated temperature, for example titanium, aluminium or alloys thereof. A circular aperture 20 is cut through all four sheets as shown, either before or after the sheets are stacked into the pack 10.

Figure 2:
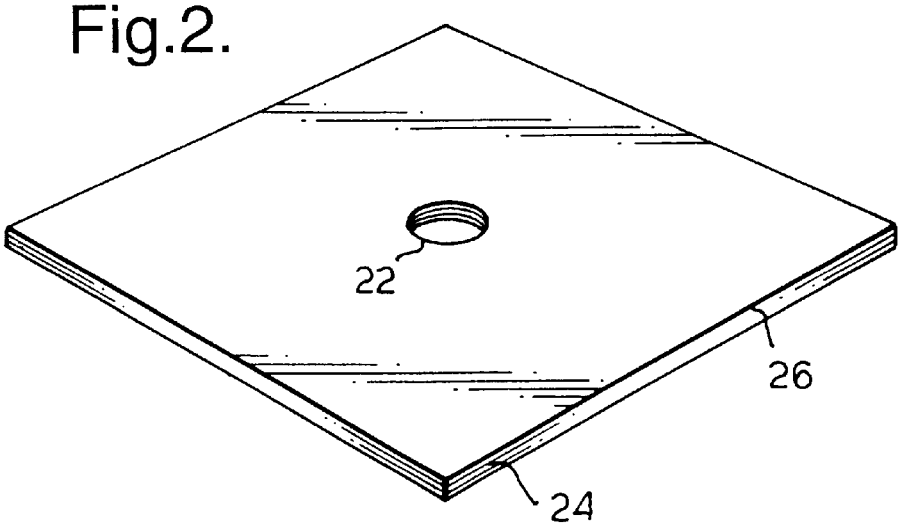
FIG. 2 shows the pack of sheets of FIG. 1 after they have been bonded together.

In the next step of the method according to the invention, shown in FIG. 2, the sheets 12, 14, 16, 18 are bonded together by an edge bond 22 located around the aperture 20, edge bonds 24 located along the outer edges 26 of the sheets, and other internal bond lines (not shown).

For example, stop-off material, e.g. silica, may be applied to certain areas between the adjacent sheets of the pack 10 to prevent diffusion bonding of the sheets in those areas whilst the lines or areas which are to be bonded are not covered by stop-off material. The assembled pack 10 of sheets is then placed in a heated press (also not shown) and compressed at a temperature and for a time sufficient to diffusion bond the sheets of the pack together in the lines or areas that are not covered by stop-off material, in order to produce the edge bonds 24, 26 and the selected other bond lines indicated above. Instead of diffusion bonding, the sheets of the pack may, of course, be bonded together in the said selected areas by other means, for example explosion bonding or welding, but diffusion bonding is preferred.

Figure 3:
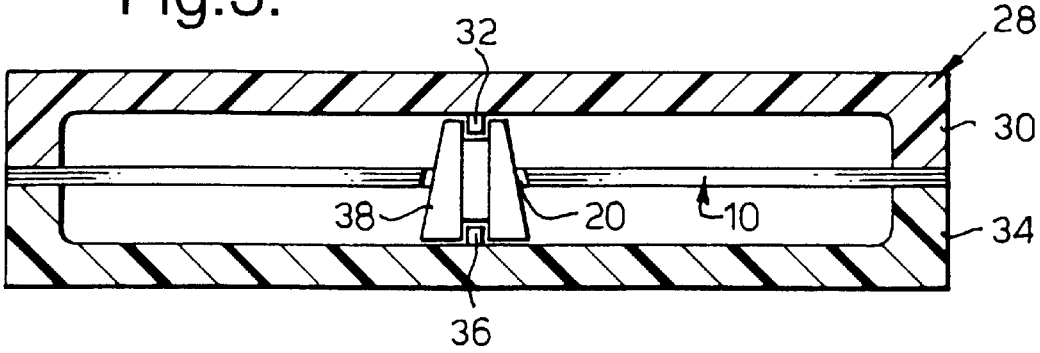
FIG. 3 is a cross section through a forming tool into which the bonded pack of sheets of FIG. 2 has been inserted for superplastic forming according to one aspect of the present invention.

Next, according to one embodiment of the invention, the pack 10 of sheets is placed in a forming tool 28, as shown in FIG. 3. This forming tool 28 comprises an upper mould 30 provided with a location pin 32, and a lower mould 34 provided with a corresponding location pin 36. The two pins 32, 36 are arranged to be aligned with the aperture 20 in the pack 10 and to receive and locate therebetween an insert plug 38 formed of the same material as the sheets 12, 14, 16 and 18. As illustrated, the insert plug 38 is a reasonably close fit in the aperture 20.

Figure 4:
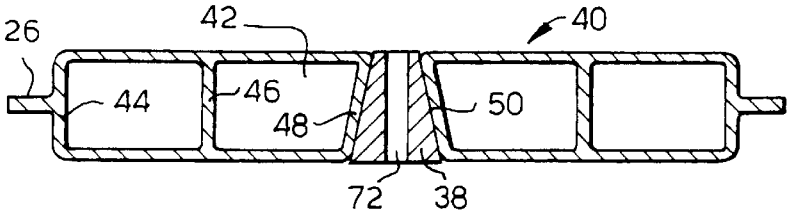
FIG. 4 is a detailed cross section through a structure according to the present invention produced by superplastic forming using the tool of FIG. 3.

Gas supply pipes (not shown) are arranged to supply inert gas to the stopped-off areas within the pack for superplastic forming. In order to facilitate the supply of inert gas to all these areas within the pack, adjacent areas can be connected together, as is known, by openings within the pack 10; alternatively an external manifold could be used. The inert gas is now injected into the stopped off areas of the pack to "inflate" the outer sheets 12, 18 of the pack to conform to the internal shape of the superplastic forming tool 28 and produce a panel 40. During superplastic forming, the sheets 14, 16 form a number of closed cells 42 in the panel 40, as can be seen in FIG. 4, due to the selective application of stop-off to the adjacent faces of sheets 14 and 16.

More especially, the superplastic forming process forces at least the upper sheets 12, 14 and the lower sheets 16, 18 apart, except in the linear regions where the sheets are bonded together. Here, the sheets cannot move away from one another and so they stretch and form external side walls 44 centred about the edge bonds 26, folded-back double-thickness internal side walls 46 centred about the internal bond lines, and opening defining side walls 48 centred about the edge bond 22 and defining an insert opening 50. The superplastic forming process is performed in such a way that the two thicknesses of the side walls 46 are diffusion bonded together to form a single composite wall; and in such a way that the side walls 48 defining the insert opening 50 conform to and are diffusion bonded to the outer wall of the insert plug 38.

Figure 5:
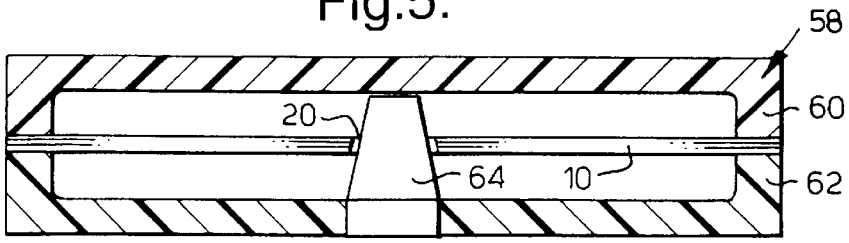
FIG. 5 is a cross section through a forming tool into which the bonded pack of sheets of FIG. 2 has been inserted for superplastic forming according to another aspect of the present invention.
Figure 6:
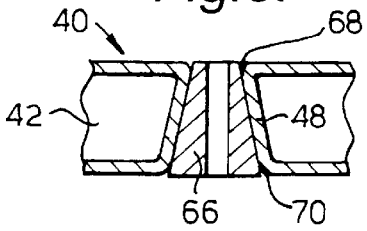
FIG. 6 is a detailed cross section through a structure according to the present invention after superplastic forming using the tool of FIG. 5 to produce a panel and after bonding an insert plug into the superplastically formed panel.

In an alternative embodiment of the invention, illustrated in FIGS. 5 and 6, the bonded pack 10 is placed in a forming tool 58 comprising an upper mould 60, and a lower mould 62 provided with a core plug 64. The core plug 64 is located so as to be aligned with the aperture 20 in the pack 10 and is a relatively close fit therein. Superplastic forming takes place as described above and results in a superplastically formed panel 40 again having closed cells 42 with side walls 44, 46 and 48, but in this instance the side walls 48 are formed around but are not diffusion bonded to the core plug 64. As before, the side walls 48 define an insert opening 50.

After forming has taken place, the panel 40 is removed form the forming tool 58 and an insert plug 66 is now inserted into the insert opening 50 defined by the side walls 48 and is fixed therein by means of edge welds 68, 70. Following this, the insert plug 66 is rigidly fixed in place by means of HIP bonding.

In either case, the result is a structure comprising a superplastically formed panel 40, which has an insert opening 50 defined by the cell side walls 48, and an insert plug 38,66 received in the insert opening 50 and bonded to the side walls 48.

Figure 7:
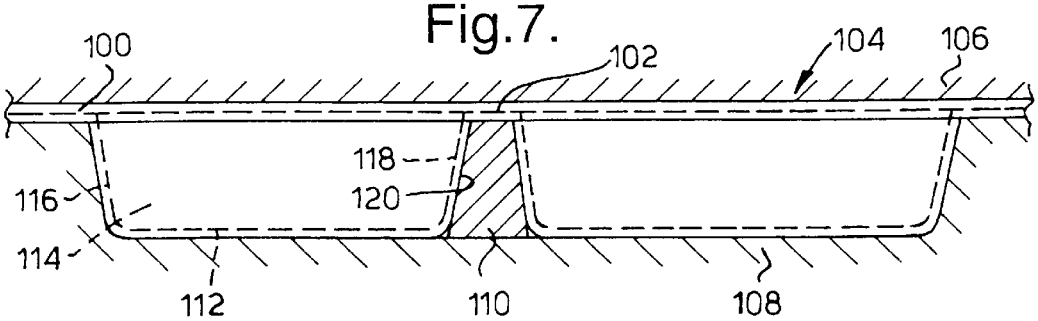
FIG. 7 is a cross section through a forming tool into which a modification of the bonded pack of sheets of FIG. 2 has been inserted for superplastic forming according to a further aspect of the present invention.

In a further embodiment of the invention, illustrated in FIG. 7, a modified bonded pack 100 is employed in the superplastic forming process. This modified pack 100 again includes four sheets of a material that has superplastic properties at elevated temperature but, by contrast with the bonded pack 10, the pack 100 omits the aperture 20 and instead has an insert location 102 provided by a defined sheet region of the pack. In this sheet region 102, the sheets are bonded together prior to insertion of the pack 100 into a forming tool 104, as before.

The forming tool 104 comprises an upper mould 106, which is essentially a flat surface, and a lower mould 108, which is cup-shaped and which is provided with a core plug 110. The bonded pack 100 is located in the mould 104 with the defined sheet region 102 aligned with the core plug 110.

Superplastic forming takes place as described above and results in a superplastically formed panel 112 shown in dashed lines having closed cells 114 with side walls 116 and 118. The side walls 118 define an insert opening 120, which in this instance is closed by the bonded portion of the defined sheet region 102.

After forming has taken place, the panel 112 is removed from the forming tool 104 and an insert plug 66 is inserted into the insert opening 120 defined by the side walls 118 and is fixed therein by means of edge wells. Following this, the insert plug 66 is rigidly fixed in place by means of HIP bonding.

The resultant structure differs from those produced according to the method described with reference to FIGS. 3 and 4 and with reference to FIGS. 5 and 6 in that the panel 112 has an asymmetric shape about a central plane and has an insert opening 120 which is closed at one end.

In the described embodiments, the insert plug is substantially frusto-conical and is pre-formed with a central bore 72. It may also be cylindrical, and solid or machined post forming according to its intended use.

What is claimed is:

1. A superplastically formed composite structure comprising:

a panel provided by a pair of superplastically-formed sheets, which together form a plurality of cells, the panel having an insert opening therein defined by a side wall of a respective one, or side walls of respective ones, of the cells; and an insert plug received in the insert opening and bonded to the said side wall or walls.

2. A structure according to claim 1 further including face sheets forming the outer faces of the panel.

3. A structure according to claim 1 in which the insert plug is substantially solid and provides a relatively hard region in the panel capable of sustaining point loads without collapse, buckling or fracture.

4. A structure according to claim 1 in which the insert plug is generally cylindrical or frusto-conical in shape.

5. A structure according to claim 1 in which the insert plug is formed with a central bore.

6. A structure according to claim 1 in which the insert plug is made from a superplastically formable material.

7. A structure according to claim 1 in which the insert plug is made from the same material as the superplastically formed sheets and is diffusion bonded to them.

8. A structure according to claim 1 in which the insert plug is made from a different material from the superplastically formed sheets and is edge welded and HIP bonded in place.

9. A structure according to claim 1 in which the insert opening extends through the panel.

10. A structure according to claim 1 in which the insert opening is closed at one end, said one end being defined by at least one of the superplastically formed sheets.

11. A method of producing a superplastically formed composite structure comprising:

providing a pack or stack of sheets of superplastically formable material;

defining an insert location in the pack and joining the sheets together by bonds at least in the region of the insert location;

placing the pack in a forming tool and superplastically forming the sheets by heating the sheets to a temperature at which they exhibit superplastic properties and by injecting gas so as to expand the pack into a three dimensional panel having a plurality of cells, wherein the insert location is formed into an insert opening defined by a side wall of a respective one, or side walls of respective ones, of the cells; and locating an insert plug in the insert opening and bonding the plug to the said side wall or walls.

12. A method according to claim 11 in which the insert location is located over the insert plug when the pack is in the forming tool, and the insert plug is diffusion bonded to the said side wall or walls during the superplastic forming.

13. A method according to claim 11 in which the insert location is located over a withdrawable core plug in the forming tool for forming, and after forming the core plug is withdrawn and the insert plug is inserted into the insert opening and is bonded to the said side wall or walls.

14. A method according to claim 11, in which the insert location is an aperture through the pack.

15. A method according to claim 11, in which the insert location is a defined sheet region of the pack.

16. A superplastically formed composite structure comprising:

a panel comprising a pair of sheets at least one of which is superplastically formed to provide a plurality of cells, the panel having an insert opening therein defined by a side wall of a respective one, or side walls of respective ones, of the cells; and an insert plug received in the insert opening and bonded to the said side wall or walls.

17. A method of producing a superplastically formed composite structure comprising:

providing a pack or stack of sheets of superplastically formable material;

defining an insert location in the pack and joining the sheets together by bonds at least in the region of the insert location;

placing the pack in a forming tool and superplastically forming at least one of the sheets by heating the sheets to a temperature at which they exhibit superplastic properties and by injecting gas so as to expand the pack into a three dimensional panel having a plurality of cells, wherein the insert location is formed into an insert opening defined by a side wall of a respective one, or side walls of respective ones; and locating an insert plug in the insert opening and bonding the plug to the said side wall or walls.

* * * * *